United States Patent [19]

Raymond

[11] Patent Number: 4,519,109

[45] Date of Patent: May 28, 1985

[54] TOOTH BRUSH

[76] Inventor: Beach D. Raymond, 8-20, Wada-cho, Atami-shi, Shizuoka-pref, Japan

[21] Appl. No.: 601,020

[22] Filed: Apr. 16, 1984

[51] Int. Cl.[3] ..... A46B 9/04; A46B 5/02

[52] U.S. Cl. ..... 15/110; 15/143 R; 15/167 R; 434/233; 434/263; 40/314

[58] Field of Search ..... 15/110, 167 R, 143 R; 273/26 R; 434/233, 263, 162; 40/314

[56] References Cited

U.S. PATENT DOCUMENTS

| | | | |
|---|---|---|---|
| 2,163,211 | 6/1939 | Wolf | 15/110 |
| 2,253,210 | 8/1941 | Psiharis | 15/110 X |
| 2,304,319 | 12/1942 | Saltzman | 15/143 R X |
| 2,925,273 | 2/1960 | Pratt | 273/26 R |

*Primary Examiner*—Peter Feldman

*Attorney, Agent, or Firm*—Moonray Kojima

[57] ABSTRACT

This invention is concerned with an improvement of a tooth brush for keeping users' decayed teeth and gingival portion in a hygeine and healthy condition comprising a grip portion of a tooth brush shank to be held between their thumb and first finger with respect to their lower jaw and upper jaw, which shank being formed intermediate thereof in an opposedly inclined shape so as to enable them to cleanly brush their tooth especially cased with gold and also whole gingival surface area by a finger massage operation. The invention further involves a construction wherein the grip portion of tooth brush shank is provided rearwardly with a projection which is adapted to press against the gingival portions thereby enabling users to perceive the seat of gingivitis at an earlier stage by feeling pain when the projection is applied to their gingival portion.

3 Claims, 6 Drawing Figures

TOOTH BRUSH

BACKGROUND OF THE INVENTION

Hithertore varieties of tooth brushes for cleaning ones' tooth casing have been devised for practical use and users have in reality used these brushes under the instructions of dental surgeons. However, the realities are that how many times they may have correctly practiced under the instructions they are not able to get rid of cavities in teeth which are gradually getting worse, without the slightest symptoms of decayed teeth getting better and better.

One of the main reasons of the above-mentioned decayed tooth geting more serious is, among many others, partly due to the fact that a stress is exclusively put on cleaning operations of the casing of dental portions and gingival portions, with the least significance being put on a finger massage operation to their gingival portions and partly due to the fact that most of the conventional tooth brushes have in the grip portion of the shank thereof formed so as to stop rotation of the intermediate portion thereof by holding the latter between the users' thumb and first finger so that when the grip portion is firmly grasped by the hand, the shank is easily made to rotate, failing to completely clean a row of teeth and gingival portion closely in contct therewith.

OBJECTS OF THE INVENTION

Accordingly the present invention has been devised to eliminate or mitigate all the above-mentioned drawbacks and disadvantages of the conventional types, and has for one of its main objects provision of a tooth brush which it is easy for users not only to clean the rows and casing of their teeth but also to massage their gingival portions.

Another object of the invention is to provide a tooth brush which has a shank provided in the upper and lower sides of intermediate grip portion thereof with an inclined surface portion respectively, so that merely by firmly holding either of said opposedly inclined surface portions inwardly of a thumb and the other inclined surface portion outwardly of a first finger in unmovable relation with the circumferential direction of the shank, thus enabling the users to clean the desired dental and gingival portions in contact therewith.

Another object of the invention is to provide a tooth brush wherein the shank of a tooth brush has a pair of two opposed inclined surface portions which are either colored with four different colors or marked with four different characters, respectively, in positions corresponding to cleaning portions of an oral cavity model and teeth row model; By so providing, the same front part of the intermediate grip as the color or character provided on the foregoing models may be firmly held by means of users' inner thumb portion, thereafter the rear part of the inclined surface portion opposite to the intermediate grip being held by means of their inner first finger whereby a tooth brush is suitably held in the inside of their hand at the most suitable angle at which both the teeth raw and the gingival portion of users can be cleaned.

As has been mentioned in the foregoing description, the tooth brush of the present invention comprises a shank having its intermediate grip portion provided with four inclined front and rear portions either colored with four different colors or marked with four different characters, respectively, whilst an oral cavity model is similarly colored with four different colors or marked with four different characters each corresponding to the former colors or characters of the inclined surface arears so as to make it easy for users to visually discern the cleaning portions of users' teeth and gingival portions; Consequently, most users are able to easily decide as to how to treat the tooth brush subject to their individual teeth row and gingival portion. Incidentally, the above-mentioned four colors or four characters on the tooth brush grip are quite enough even for children to learn how to use the tooth brush of the invention in a short a length of time that they become easily accustomed to brushing their teeth in the best way by use of the tooth brush of the invention.

A still further object of the invention is to provide a tooth brush which has a shank provided in an extremity thereof with a projection in integral relation so that merely by abutting the same projection against each of users' gingival portions, they can perceive whereabouts of gingivitis going on, thus being abe to undergo dental treatment at an earlier stage.

BRIEF DESCRIPTION OF ACCOMPANYING DRAWINGS

DETAILED DESCRIPTION OF INVENTION

Figure 1:
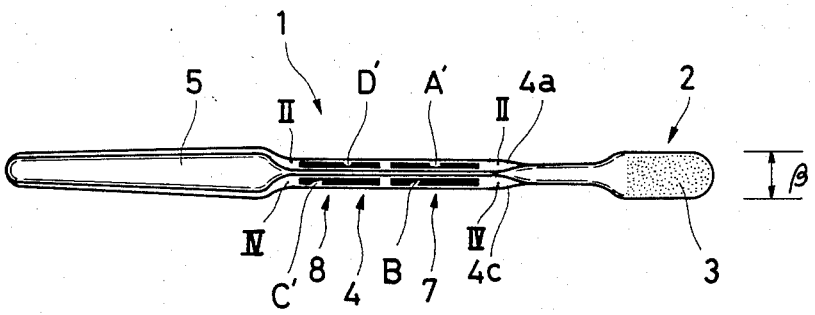
FIG. 1 is a top plan view of a tooth brush embodying the present invention.

Setting forth now in detail a preferred embodiment of the invention in conjunction with the accompanying drawings character A generally designates a main tooth brush of the invention body which comprises a shank 1 having a foremost brush portion 2 piled in one extremity thereof, therewith a brush portion 3, an intermediate grip portion 4 approximately central of said shank 1 and a rear grip portion 5 in opposition to said fore-most brush portion 2.

In accordance with the present embodiment of the invention, said brush portion 2 is, with respect to its axial length $\alpha$, piled with brush elements having a shorter length than the width $\beta$ of said portion 2 in order to make it easy for users to frictionally slide said brush portion 2 in abutment against their teeth and gingival portion. Further said brush portion 2 of the foremost shank portion 1 is formed thin, compared with the intermediate grip portion 4 and the rear grip portion 5.

Figure 3:
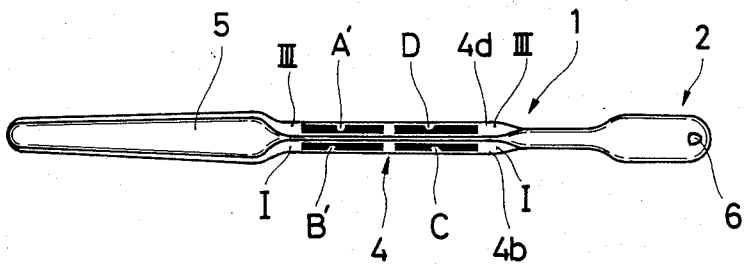
FIG. 3 is a bottom plan view thereof.
Figure 4:
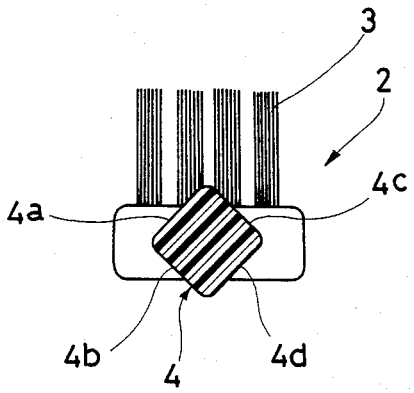
FIG. 4 is a perspective view taken on the line 1—1 of FIG. 2.

Said intermediate grip portion 4 has four sides that are composed of inclined surface areas 4*a*, 4*b*, 4*c* and 4*d* in cross section as defintely shown in FIG. 4 of the accompanying drawings. In the lower end of the brush portion 2 of the shank 1 there is provided a projection 6 integrally with said shank 1 as shown in FIGS. 2 and 3.

Said inclined surface areas 4*a*, 4*b*, 4*c* and 4*d* are adapted to rigidly prevent rotation of the shank 1 which otherwise might rotate between users' inner thumb portion and inner first finger portion when they are carrying out massaging operation of their teeth and gingival portion. Each of said areas is divided into a front portion 7 and a rear portion 8 midway of axial direction, being colored or marked in correspondence to an upper jaw or palate model 9*a* and a lower jaw or submaxille 9*b* which will be referred to hereinafter.

Figure 2:
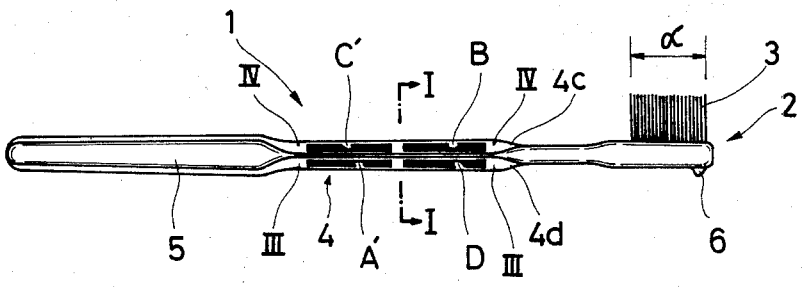
FIG. 2 is a side elevational view thereof.

By way of example with respect to FIGS. 1 thru 3 of the accompanying drawings, the inclined surface area 4*a* is marked with numeral II and the front part A' to be forced by users' inner thumb portion is colored with red; In contrast thereto, the rear part A' of the inclined surface area 4*d* wherein users' inner first finger portion is to be disposed is likewise colored with red; the inclined surface area 4*c* is marked with numeral IV and the front part B is colored with blue, further the rear poart B' of the inclined surface area 4*b* opposite to said surace area 4 cis also colored with blue.

Figure 5:
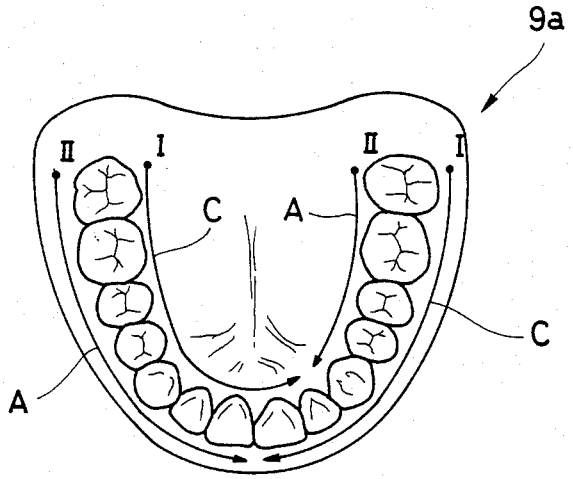
FIG. 5 is a model showing a row of teeth on the upper jaw of a man.
Figure 6:
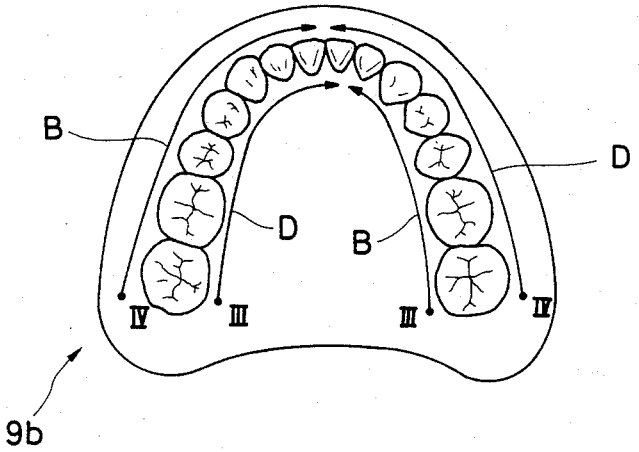
FIG. 6 is similarly a model showing a row of teeth on the lower jaw of a man.

Meanwhile the inclined surface area 4*b* is marked with numeral I and the front part C is colored with green, the rear part C' opposite to said area 4*b* being likewise colored with green. Further the front part D is marked with numeral III and colored with yellow and, in correspondenced thereto, the rear part D' of the upper inclined surface area 4*a* is colored with yellow. Both in FIG. 5 showing a model 9*a* of an upper jaw or the palate and in FIG. 6 showing a model 9*b* of a lower jaw or the submaxilla, wherein a line is drawn along a row of users' teeth in correspondence to each color of said inclined surface area and at the same time each of said numerals is marked in correspondence to each color and numeral of said inclined surface area. Thereafter users may put their inner thumb on the red-colored front portion A of the upper inclined surface area 4*a* of the intermediate grip portiobn 4 and hold the red-colored rear portion A between their inner finger and inner thumb whereby said brush 3 is made to turn upwardly of itself. At this angle a row of teeth and gingival portion of the upper left hand-side cheek and the right hand-side of users' tongue can be brushed. These positions are marked with numeral II and a red line A'.

Users may put their inner thumb portion on the blue-colored front portion B against the blue-colored rear portion B' of the inclined surface area 4*d* opposite to said front portion A, with the shank 1 held between their other fingers and palm so as to keep the brush portion 3 in a downwardly inclined relation.

In the aboved-mentioned state, the range within which users are able to use a tooth brush of the invention freely in a natural posture is limited to their right hand-side tongue and the inside of their left-hand side cheek. Thus these portions are marked with numeral IV of said inclined surface areas and a blue line B defining the limit d range for brushing.

On the other hand, when users put their inner thumb portion on the green-colored front part C of the lower inclined surface area 4*b* whilst abutting their inner finger portion against the green-colored rear part C' of the upper inclined surfaced area 4*c* opposite to said area 4*b*, with the other fingers and palm holding the shank 1 therebetween, the brush portion 3 is positioned in upwardly inclined relation. The range within which users are able to brush in this state is limited to their left hand-side tongue and the inside of their right hand-side cheek as is shown in FIG. 5. Thus these portions are marked with numeral I of said inclined surface areas and a green line C defining the limited range for brushing. Then in the last place, users put their thumb on the yellow-colored part D of the lower inclined surface area 4*d*, whilst putting their inner first finger on the yellow-colored rear part D' of the upper inclined surface area 4*a* opposite to said area 4*d*, with their other fingers and palm holding the shank 1 therebetween whereby the brush portion 3 is positioned in downwardly inclined relation.

In this state, the range within which users are able to brush freely is limited to the inside of their right hand-side cheek of the lower jaw and the left hand-side tongue as is clearly shown in FIG. 6.

These portions are marked with numeral 3 of said inclined surface area and a yellow line D defining the limited range for brushing.

As is clearly evident from the foregoing description, the tooth brush embodying the present invention is so provided as orients itself in a fixed direction by pressing particular front parts of said inclined surface areas of the intermediate grip portion with users' thumb so that if adults teach children as to the position of their individual oral cavity to which the tooth brush of the invention is applicable and as to the limited range for brushing, and if adults themselves learn said position and said limited range, both adults and children themselves can naturally get accustomed to the habits of holding the tooth brush of the invention always in a fixed position and carrying out brushing operation of their teeth and gingival portion correctly corresponding to said inclined surface areas as instructed by their thumb.

Incidentally, in the preceding embodiment, description has been illustratively made of the case only with the inclined surface areas, and a model of teeth raw, with said model marked with numeral and colored with some kinds of colors. However, either of them is enough.

In addition thereto, these numeral and colors may be replaced with any other suitable characters or signs.

What is claimed is:

1. A toothbrush comprising a handle extending in a plane;

a base structure having two sides and extending from said handle in said same plane;

a set of brushes attached to one side of said base and disposed to be perpendicular to said plane;

a protrusion disposed on the other side of said base;

wherein said handle has a holder portion comprising a front portion and a rear portion, said front portion being closest to said brushes;

wherein said front portion and said rear portion each has four inclined surfaces positioned at right angles to next adjacent surfaces, with at least a pair of next adjacent surfaces being at substantially 45° angle to a plane perpendicular to said plane of said base;

wherein each of said surfaces in said front portion has a different mark, and each of said surfaces in said rear portion has a different mark, with said marks in both front portion and said rear portion corresponding to thumb and first finger of a person holding said toothbrush when brushing selected parts of the mouth of said person and being as follows, as viewed from along the plane of said base towards said brushes;

front portion; left upper surface, first mark; right upper surface, second mark; right lower surface, third mark; and left lower surface, fourth mark;

rear portion; left upper surface, said third mark; right upper surface, said fourth mark; right lower surface, said first mark; and left lower surface, said second mark;

wherein for a right hand, said front portion is for placement of a thumb, and said rear portion is for placement of a first finger, with placement of said thumb on a certain marked surface of said first portion, and placement of said first finger on a surface of corresponding mark, for brushing the following locations of said teeth in said mouth;

first mark, upper jaw left outside surface of said teeth and upper jaw right inside surface of said teeth; second mark, lower jaw left outside surface of said teeth and lower jaw right outside surface of said teeth; third mark, lower jaw left inside surface of said teeth and lower jaw right inside surface of said teeth; and fourth mark, upper jaw right inside surface of said teeth and upper jaw left outside surface of said teeth.

2. The toothbrush of claim 1, wherein said marks are different colors.

3. The toothbrush of claim 1, wherein said marks are different characters.

* * * * *

UNITED STATES PATENT AND TRADEMARK OFFICE

CERTIFICATE OF CORRECTION

PATENT NO. : 4,519,109

DATED : May 28, 1985

INVENTOR(S) : Raymond Daryl Beach

It is certified that error appears in the above—identified patent and that said Letters Patent is hereby corrected as shown below:

Page 1, the title page, the name of the inventor should be

---- Raymond D. Beach ---.

Signed and Sealed this

*Eighth* Day of *October 1985*

[SEAL]

*Attest:*

DONALD J. QUIGG

*Attesting Officer*

*Commissioner of Patents and Trademarks—Designate*